United States Patent [19]

Ahangarzadeh

[11] 4,236,734

[45] Dec. 2, 1980

[54] WELL TUBING COUPLING SYSTEM

[75] Inventor: Mansour Ahangarzadeh, Bedford, Tex.

[73] Assignee: Otis Engineering Corporation, Dallas, Tex.

[21] Appl. No.: 926,277

[22] Filed: Jul. 20, 1978

[51] Int. Cl.[2] ..... F16L 39/00

[52] U.S. Cl. ..... 285/26; 166/189; 285/86; 285/137 A

[58] Field of Search ..... 285/25, 137 A, 26, 24, 285/27, 28, 29, 86; 166/189, 347

[56] References Cited

U.S. PATENT DOCUMENTS

| | | | |
|---|---|---|---|
| 891,719 | 6/1908 | McMillan | 285/29 |
| 3,625,281 | 12/1971 | Herd | 166/189 X |
| 3,934,648 | 1/1976 | Amancharla et al. | 285/25 X |
| 4,067,385 | 1/1978 | Schwager et al. | 166/189 X |

*Primary Examiner*—Thomas F. Callaghan

*Attorney, Agent, or Firm*—H. Mathews Garland

[57] ABSTRACT

A well bore tubing system for releasably coupling upper tubing strings with lower tubing strings. The system includes an orienting body connectible on the upper end of a well packer and having a pair of separate laterally spaced longitudinal bores, each having a locking recess and a seal surface, a longitudinal side orienting surface along the body, an upper end male guide surface leading to the orienting surface, an orienting head assembly to releasably couple with the orienting body comprising an orienting head having two longitudinal bores alignable with the bores in the orienting body and a lower end female guide surface engageable with the male surface on the orienting body, a longitudinal orienting arm secured on the guide head having a longitudinal orienting surface engageable with the orienting surface on the orienting body, and a tubular seal and latch assembly secured at one end in each of the bores of the orienting head. The orienting body is secured on a well packer set in a well bore supporting two lower tubing strings. Two upper tubing strings are connected with the orienting head assembly and run into the well bore until the orienting arm engages the orienting body turning the orienting head, upper tubing strings and seal and latch assemblies which are aligned with and telescoped into the bores of the orienting body locking the head assembly into the body. The upper tubing strings and head assembly may be pulled and rerun as desired.

12 Claims, 22 Drawing Figures

WELL TUBING COUPLING SYSTEM

This invention relates to well tools and more specifically relates to a well tubing coupling system for connecting a removable upper tubing string system with a lower tubing string system and packer.

It is common practice to drill oil and gas wells through multiple production zones in a well bore. Such a well bore is usually lined with a string of casing which is then perforated at the production zones to permit oil and gas flow into the well bore through the casing. Suitable well packers and production tubing is installed within the casing to isolate the producing zones and connect the producing zones each with separate strings of production tubing extending to the surface. Current practice normally limits the number of the production tubing strings to two. Also, current safety regulations preclude production of oil and gas through the annulus in the well bore between the tubing strings and casing. By confining the production of fluid flow to the producing strings corrosion of the well casing is minimized and pressure stress of the casing is prevented.

It will be apparent that tubing string corrosion and other conditions which may develop during the production of a well often requires the replacement of production tubing strings. It is preferable that the tubing strings in a well bore above a packer be replaceable without disturbing the packer or the tubing strings below the packer. Such well equipment capability results in minimizing the time during which a well must be shut in. In the past apparatus has been available for servicing and replacing upper tubing string sections above packers. It has been common practice particularly in offshore well installations to place packers and lower tubing string systems at desired locations in well bores and thereafter insert the upper tubing string systems as a unit from the surface into the upper packer. The lower tubing string sections are supported in the well casing from the packer while the upper tubing string sections are supported from the wellhead. The currently available systems which permit replacement of the upper string sections above the packer include structure which limits more than desirable the diameter of the removable tubing string sections. Also in some of the available systems one of the tubing strings is inserted into the upper end of the packer without the benefit of a lock for holding the lower end of the tubing string with the packer. It will be apparent that it is preferable to be able to use upper tubing strings having as large diameter as desired and to have tubing strings with the capability of each of the strings being lockable with the packer.

It is a particularly important object of the invention to provide a well tubing string coupling system which permits the replacement of upper tubing strings in a well bore above a packer.

It is another object of the invention to provide a well tubing string coupling system of the character described which permits the diameters of the upper production tubing strings to be maximized.

It is another object of the invention to provide a tubing string coupling system for a well which includes means for releasably locking each of the removable upper tubing strings with a well packer in the well bore.

It is another object of the invention to provide a well tubing string coupling system which is self-orienting as the lower ends of the removable upper tubing strings are inserted into releasable locked sealed relationship with a well packer supporting lower tubing strings.

It is another object of the invention to provide a well tubing string system of the character described which utilizes an orienting body on the upper end of a well packer and an orienting head assembly on the lower end of the removable upper tubing strings of the system.

It is another object of the invention to provide a tubing string system for a well wherein the removable upper tubing strings are manipulated during running and pulling as a single unit.

In accordance with the invention there is provided a well tubing string coupling system for removably connecting upper tubing string with lower tubing string in a well bore including an orienting body connectible with the upper end of a well packer and having longitudinal bore means therethrough provided with locking recess and seal surface means, a side longitudinal external orienting surface along the body, and an upper end guide surface on the body leading to the orienting surface, and an orienting head assembly releasably connectible with the orienting body comprising an orienting head having longitudinal bore means corresponding with the orienting body bore means and a lower end guide surface engageable with the guide surface on the orienting body, a longitudinal orienting arm secured along an upper end with the orienting head including an orienting surface engageable with the orienting surface on the orienting body, and tubular seal and latch means connected with the orienting head communicating with the longitudinal bore means through the head and insertable and lockable in the bore means of the orienting body when the orienting head is coupled with the orienting body.

The foregoing objects and advantages of the invention together with the specific details of a preferred embodiment thereof will be better understood from the following detailed description taken in conjunction with the accompanying drawings wherein.

Figure 1:
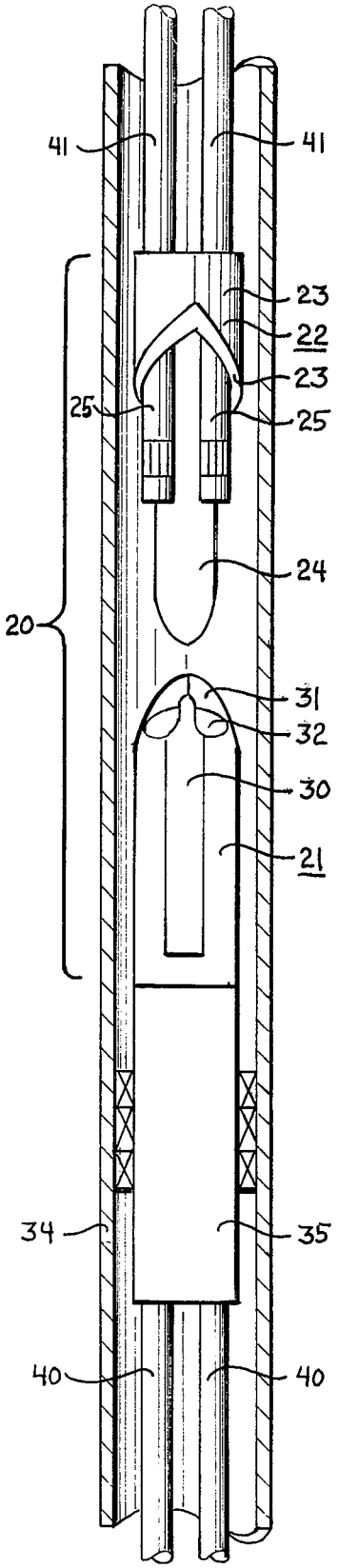
FIG. 1 is a longitudinal schematic view in section and elevation showing an intermediate step in the use of the system of the invention for coupling the lower end of two parallel upper strings of production tubing with two parallel lower strings of production tubing supported from a well packer set in the casing of a well bore.
Figure 2:
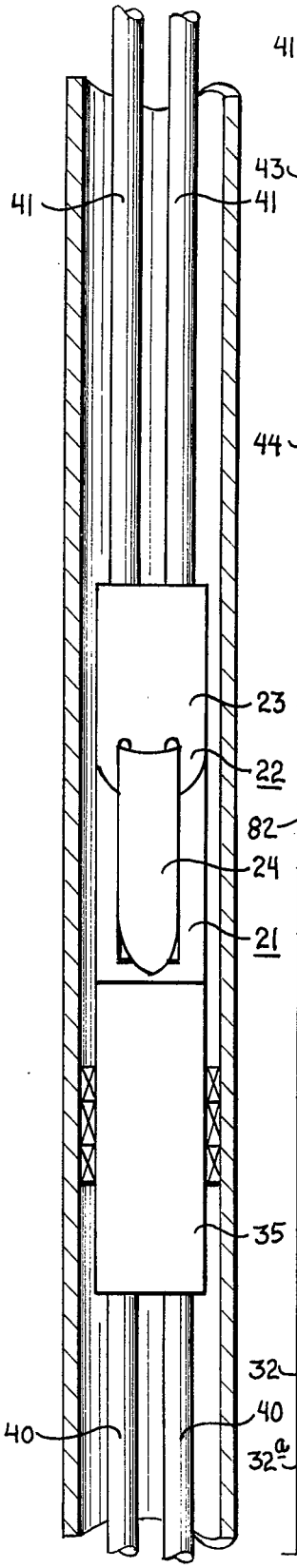
FIG. 2 is a view similar to FIG. 1 showing the upper tubing strings coupled with the lower tubing strings by the assembly of the invention.
Figure 3A:
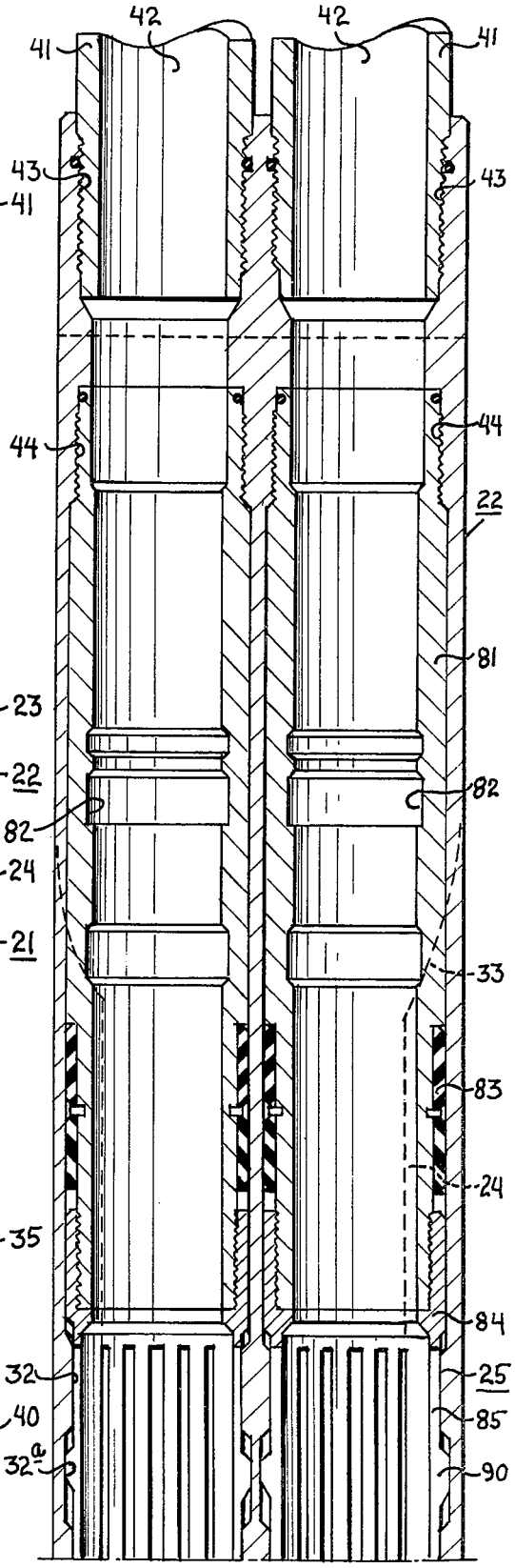
Figure 3B:
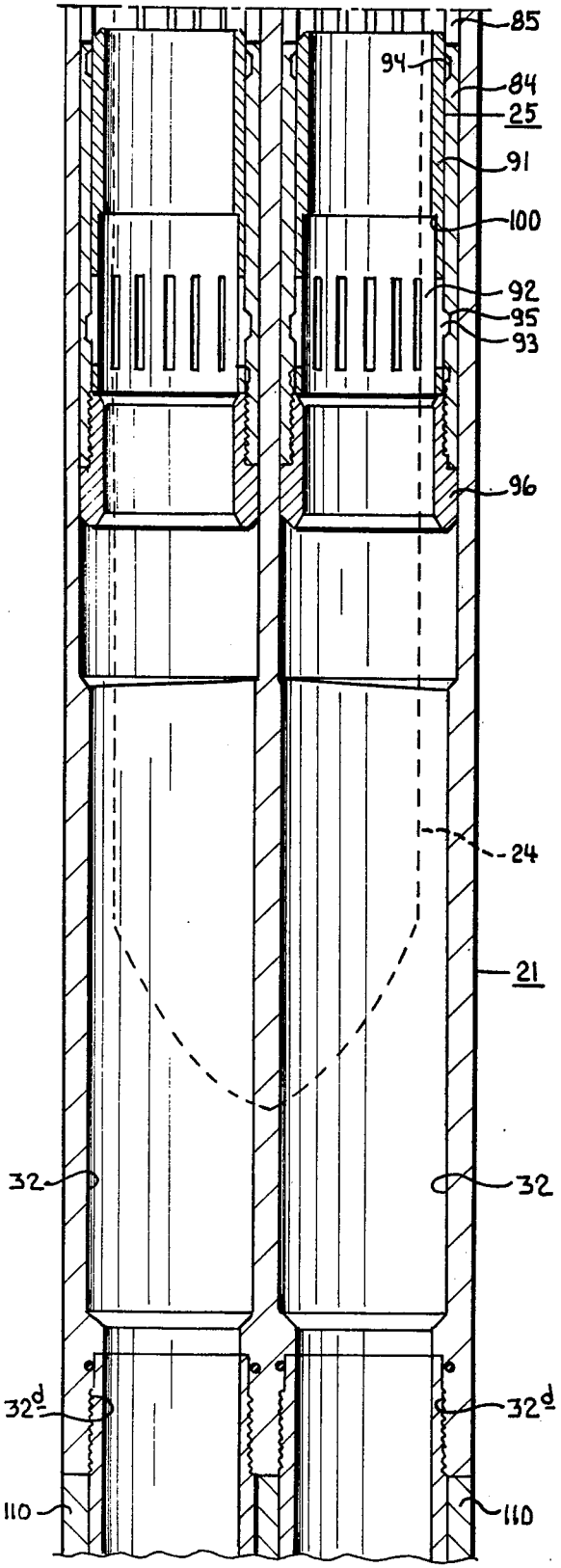
Figure 4A:
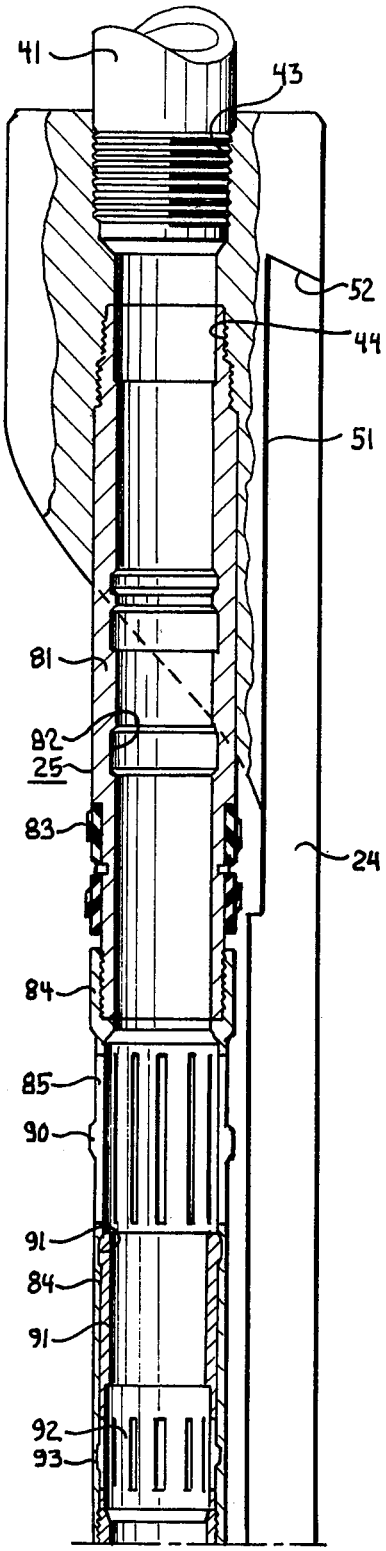
Figure 4B:
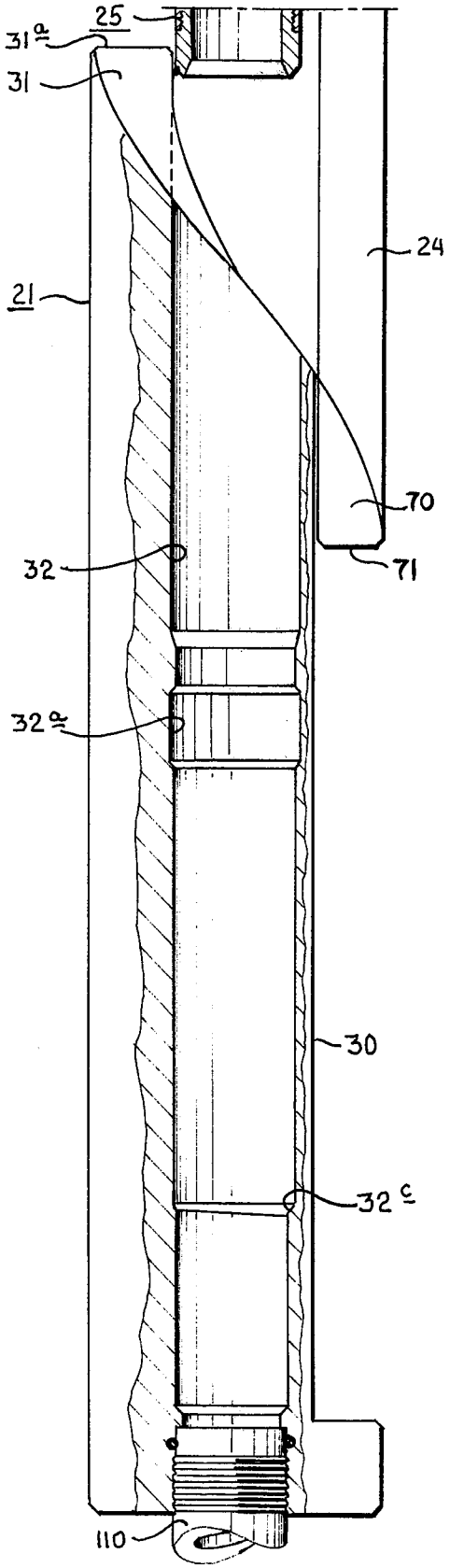
Figure 5A:
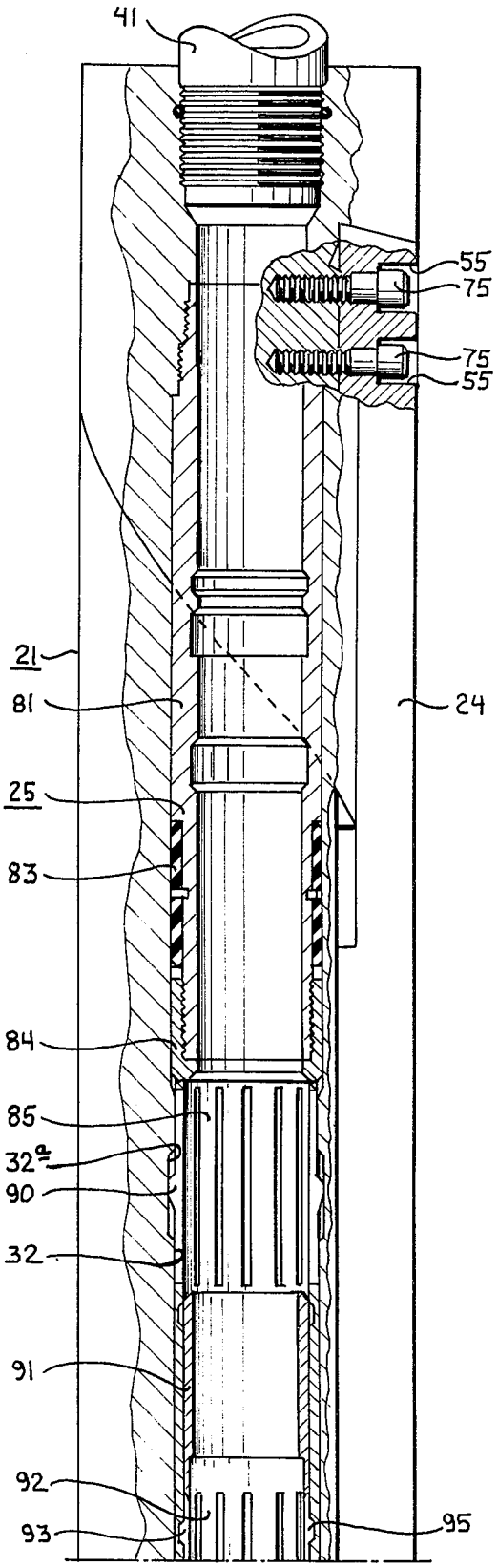
Figure 5B:
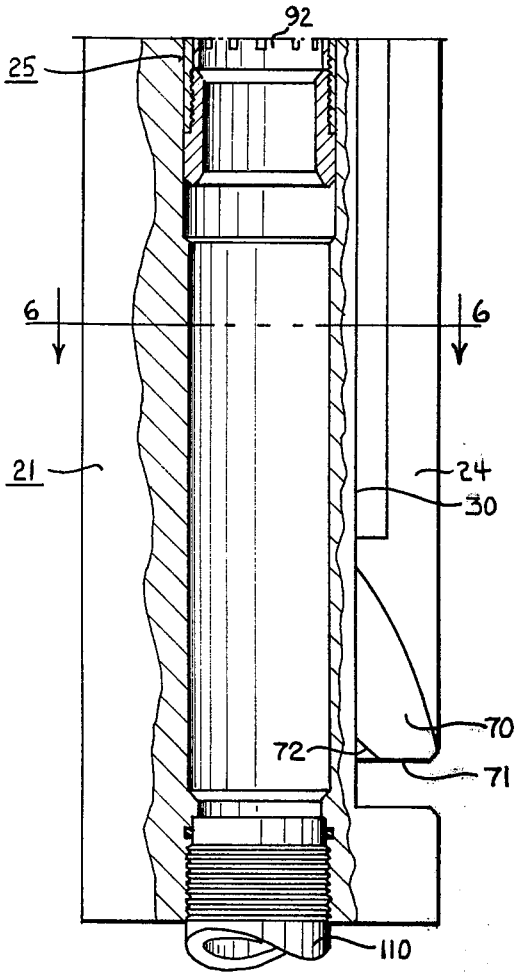
Figure 6:
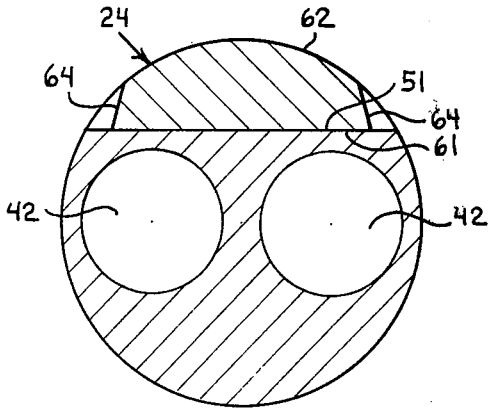
Figure 7:
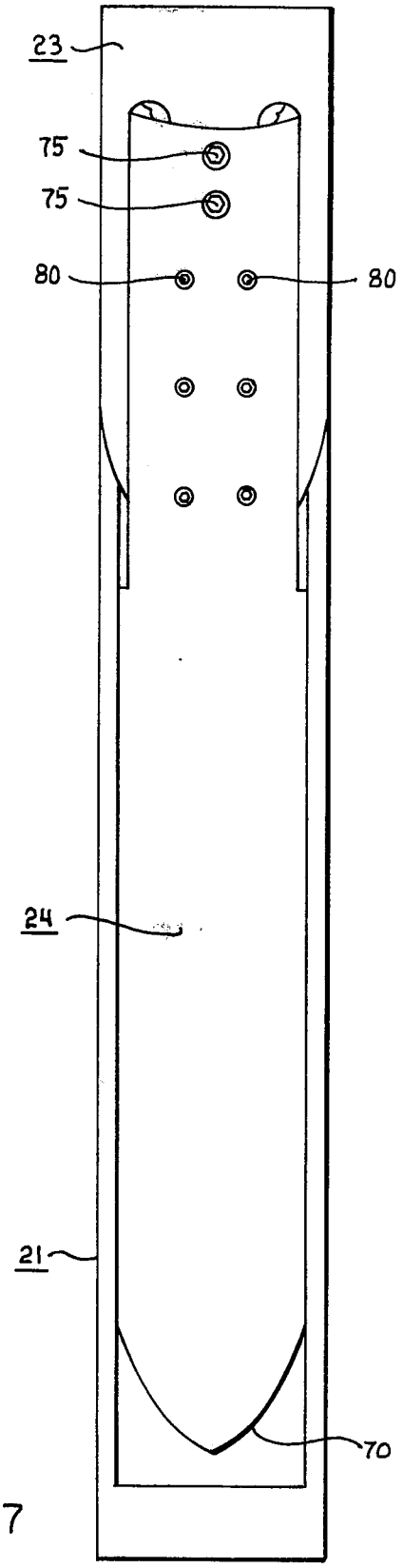
Figure 8A:
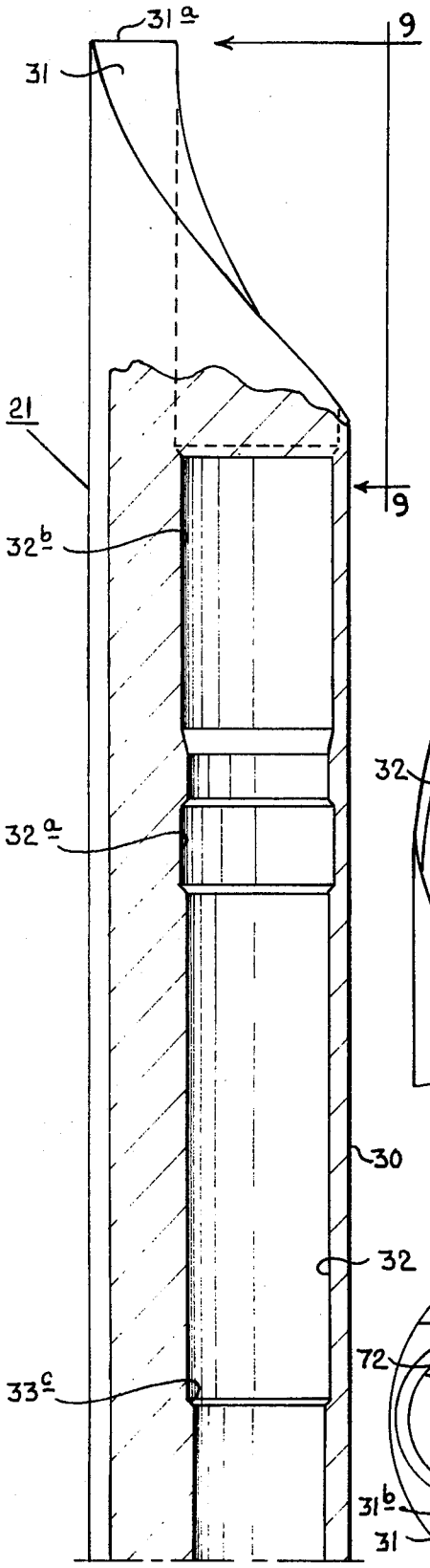
Figure 8B:
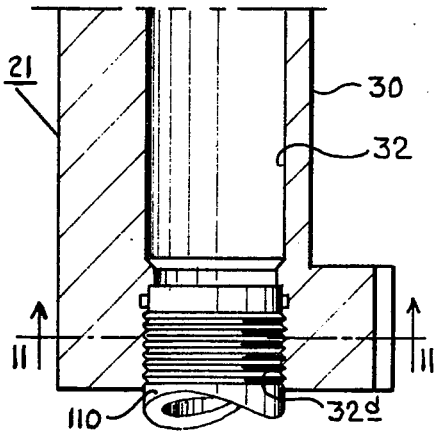
Figure 9:
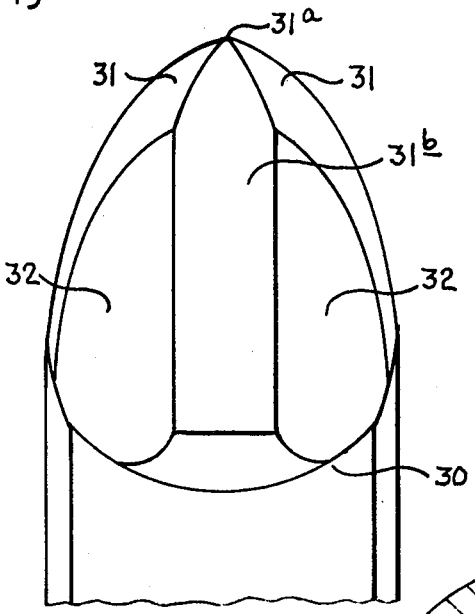
Figure 11:
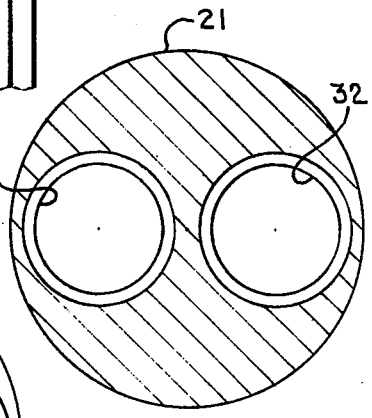
Figure 10:
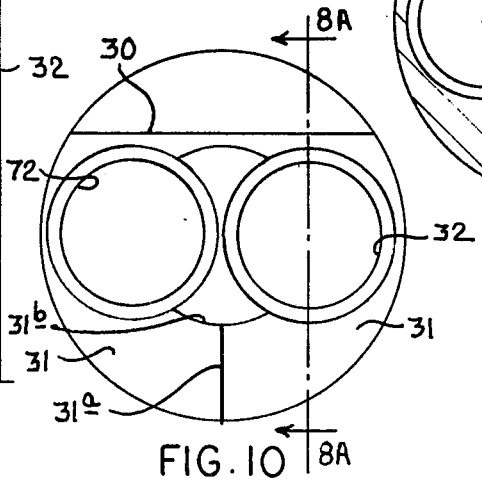
Figure 12:
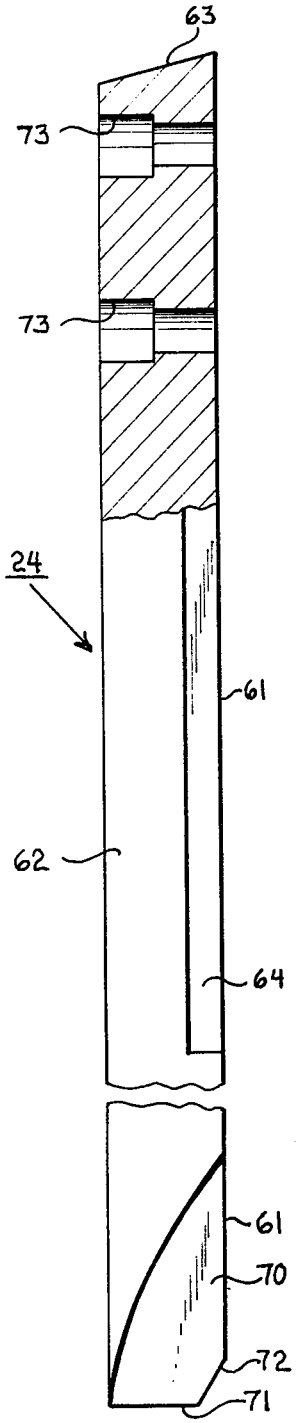
Figure 13:
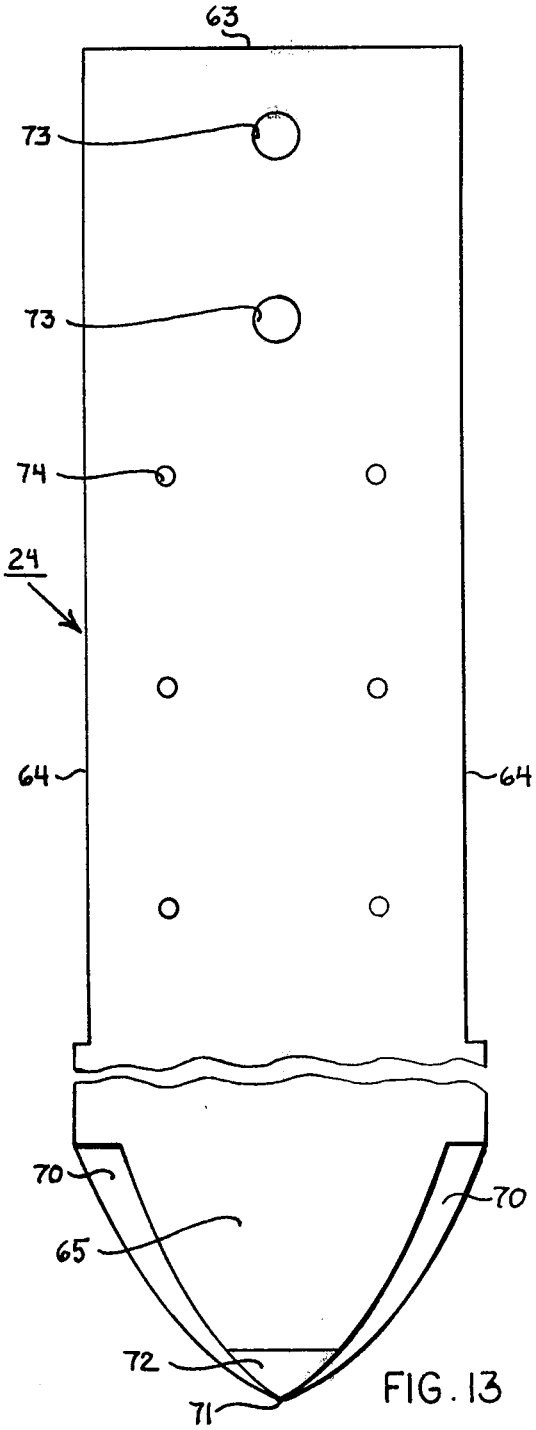
Figure 14:
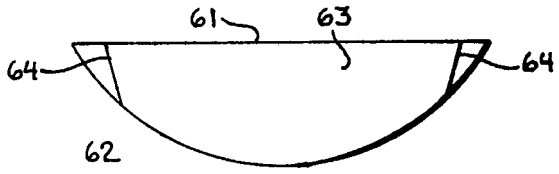
Figure 15:
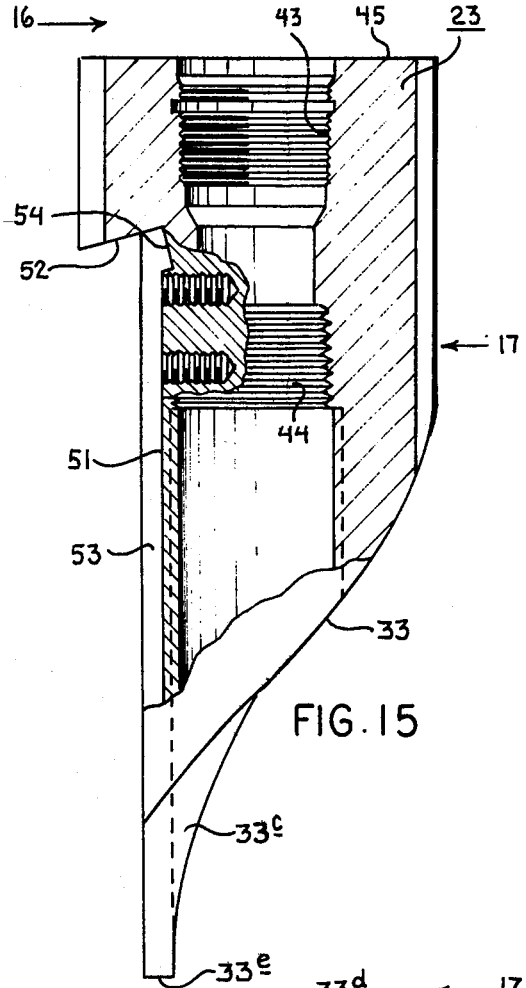
Figure 16:
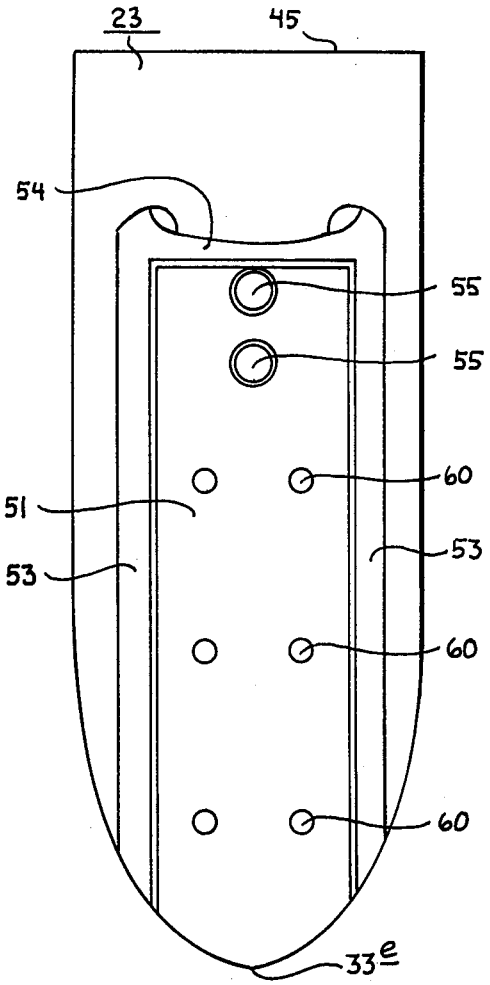
Figure 17:
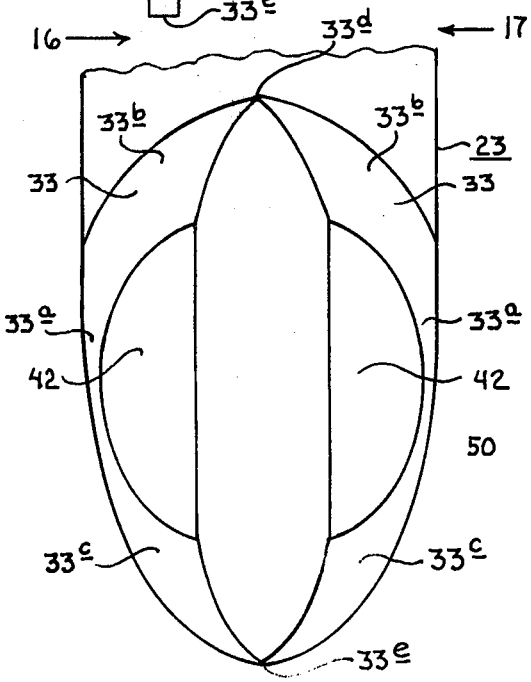
Figure 18:
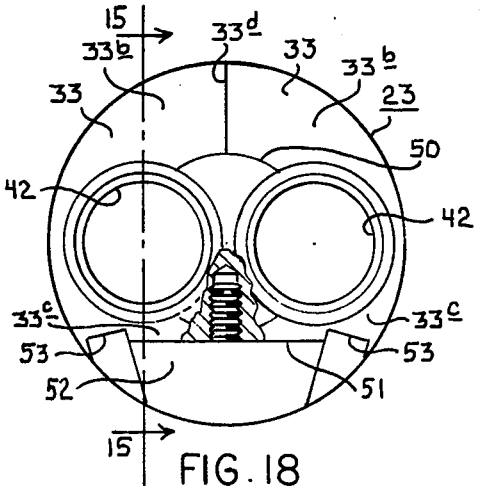

FIGS. 3A and 3B taken together form a longitudinal view in section and elevation taken along a plane intersecting both of the tubing strings in the system showing the orienting head assembly on the lower end of two upper tubing strings releasably coupled with the orienting body mounted on the upper end of a well packer as schematically represented in FIG. 2;

FIGS. 4A and 4B taken together form a longitudinal view in section and elevation along a plane intersecting one of the tubing strings in the system perpendicular to the view shown in FIGS. 3A and 3B at the intermediate stage in the installation of the system represented in FIG. 1;

FIGS. 5A and 5B taken together form a longitudinal view in section and elevation similar to FIGS. 4A and 4B showing the orienting head fully coupled with the orienting body as represented in FIGS. 2 and 3A and 3B;

FIG. 6 is a view in section along the line 6—6 of FIG. 5B;

FIG. 7 is a fragmentary longitudinal view in elevation showing primarily the orienting arm of the orienting head assembly at the final position along the orienting body when the head is fully coupled with the body as represented in FIGS. 5A and 5B as seen at 90 degrees to the right of the view shown in FIGS. 5A and 5B;

FIGS. 8A and 8B taken together form a longitudinal view partially broken away in section of the orienting body along a plane intersecting one of the two longitudinal bores through the body as seen along the line 8A—8A of FIG. 10;

FIG. 9 is a fragmentary view in elevation of an upper end portion of the orienting body as seen at 90 degrees to the right of FIG. 8A generally along the line 9—9 designated on FIG. 8A showing the guide surface at the upper end of the orienting body and an upper end portion of the orienting side surface on the body;

FIG. 10 is a top end view of the orienting body rotated 90 degrees counterclockwise from the view shown in FIG. 8A illustrating the guide surface and the side orienting surface on the body as well as the upper ends of the two bores through the body as seen from the upper end of the body;

FIG. 11 is a view in section along the line 11—11 of FIG. 8B;

FIG. 12 is a longtiduinal side view partially broken away in section of the guide arm only of the orienting head assembly of the system;

FIG. 13 is a broken longitudinal view in elevation of the guide arm as seen along a plane 90 degrees to the right of the view of FIG. 12;

FIG. 14 is an upper end view of the guide arm of FIGS. 12 and 13;

FIG. 15 is a longitudinal view of the orienting head partially broken away in sections along two separate planes, one through one of the bores through the head and one through the central portion of the head along the bolt holes used in securing the guide arm to the head;

FIG. 16 is a longitudinal view in elevation as seen along the side of the orienting head 90 degrees to the left of the view of FIG. 15 along the line 16—16 of FIG. 15;

FIG. 17 is a fragmentary view in elevation of the lower end portion of the orienting head along a plane 90 degrees to the right of the view of FIG. 15 and generally as seen along the line 17—17 of FIG. 15; and FIG. 18 is a lower end view of the orienting head rotated 90 degrees counterclockwise from the orientation of the view of FIG. 15.

Referring to FIGS. 1 and 2 a well tubing coupling system 20 embodying the features of the invention includes an orienting body 21, and an orienting head assembly 22 including an orienting head 23, a guide arm 24 secured on the orienting head, and seal and latch assemblies 25 connected into the head 23. The orienting body 21 has a flat longitudinal side orienting surface 30 and an upper end contoured guide surface 31. The orienting body is provided with parallel laterally spaced longitudinal bores 32 which are sized to receive the seal and latch assemblies 25 on the orienting head assembly. The orienting head 23 has a lower end guide surface 33 which is adapted to engage the orienting body end surface 31 when the head assembly is coupled with the body.

In the operation of the well tubing coupling system of the invention as illustrated in FIGS. 1 and 2 a well bore is lined with a casing 34 in which a suitable well packer 35 is set to seal with the inner wall of the casing at the upper end of the annulus in the well bore between the casing and dual strings of lower tubing 40 as supported from the packer. The packer may be any suitable hydraulic or mechanical set type packer as illustrated and described at pages 3950–3951 of the 1974–75 edition of THE COMPOSITE CATALOG OF OILFIELD EQUIPMENT AND SERVICES, published by World Oil, Houston, Texas. The orienting head assembly 22 is connected on the lower end of upper production tubing strings 41 which serve as handling strings during the installation of the tubing coupling system of the invention.

In operating the tubing string coupling system of the invention, the upper ends of the lower tubing strings 40 are connected into the packer 35 on which the orienting body 21 is mounted. The lower tubing strings, the packer, and the orienting body are lowered into the well casing 34 and the packer is set by standard procedures at the desired depth. It will be recognized that another packer, not shown, spaced below the packer 35 will normally be included with the lower tubing strings for properly isolating two separate producing zones leading to the separate lower tubing strings 40. After the setting of the lower tubing strings and packer 35 the head assembly 22 is secured with the lower ends of the parallel upper tubing strings 41. The guide head assembly is lowered by means of the upper tubing strings until the lower end of the guide arm 24 engages the upper end guide surface 31 on the guide body 21. Unless the upper tubing strings and the orienting head assembly 22 are rotationally oriented at the proper position for coupling with the orienting body 21 the guide arm 24 slides along the guide surface 31 causing rotation of the upper tubing strings and the assembly 22 until the inside face of the guide arm 24 is parallel with the orienting surface 30 on the body 21, thereby aligning the seal and latch assemblies 25 with the bores 32 in the body 21. The lowering of the upper tubing strings and head assembly 22 continues until the head assembly is fully coupled with the orienting body thereby providing fluid communication through the packer, the body 21, and the head assembly 22 between the lower tubing strings 40 and the upper tubing strings 41. FIG. 2 illustrates the tubing coupling system of the invention when fully operational in the well casing.

The head assembly 22 of the tubing coupling system of the invention includes the orienting head 23, the orienting arm 24, and the seal and latch assemblies 25. As illustrated in FIGS. 15–18, the orienting head 23 is a tubular member having longitudinally extending laterally spaced parallel separate bores 42 threaded along an upper end portion 43 for the connection of the upper tubing strings 41 and along a lower end portion 44 for securing the upper ends of the seal and latch assemblies 25 into the head. The upper end of the guide head is a substantially flat face 45 lying in a plane perpendicular to the longitudinal axis of the head. The lower end of the guide head is defined by the three-dimensional curved guide surface 33 providing a somewhat tapered or pointed lower end to the guide head. The guide surface 33 is actually formed by identical longitudinally extending side guide surface portions 33*a* comprising upper guide surface portions 33*b* and lower guide surface portions 33*c*. The upper guide surface portions 33*b* are convex surfaces which converge together at upper ends each sloping inwardly toward each other and merging into a longitudinal cylindrical surface portion 50 and toward lower end portions of the bores 42 which open through the lower end surfaces of the body 23. The upper ends of the convex inside guide surfaces 33*b* merge together along a line 33*d* which is essentially an internal edge at the junction of the surfaces 33*b* running substantially perpendicular to the longitudinal axis of the orienting head. The lower guide surface portions 33*c* are convergent convex curved surfaces which come together at the lower pointed end 33*e* of the guide head. The longitudinal side of the guide head opposite the guide surface 33 is provided with a longitudinal flat face 51 extending from an undercut downwardly sloping upper end face 52 through the lower end of the guide head between longitudinally extending angular recesses 53 disposed along the longitudinal opposite edges of the flat face 51. A lateral recess 54 extends across the upper end of the face 51 between the upper ends of the grooves 53. The orienting head has two longitudinally spaced bolt holes 55 aligned along the longitudinal axis of the head and a plurality of laterally and longitudinally spaced holes 60 distributed over the face 51 for bolts and screws to secure the guide arm 24 with the head.

The guide arm 24 shown in detail in FIGS. 12–14 has a flat inside face 61 and a cylindrical outside face 62. The guide arm has a sloping upper end edge 63 which conforms with the slope of the face 52 at the upper end of the face 51 along which the upper end portion of the guide arm fits on the orienting head 23. The guide arm has longitudinal opposite side edges 64 running from the upper end of the guide arm to a pointed slightly enlarged lower end portion 65. The lower end portion 65 of the guide arm is defined by convergent arcuate convex surfaces 70 which slope together at a lower pointed end 71 and an angular triangular shaped inside face portion 72 which slopes from the flat face 61 outwardly toward the curved outer face 62 of the guide arm at the lower end edge 71. The guide arm has two bolt holes 73 spaced to align with the bolt holes 55 in the orienting head 23 and longitudinally and laterally spaced bolt holes 74 positioned to align with the holes 60 along the orienting head for securing the guide arm with the orienting head. The convergent lower end surfaces 70 of the guide arm are designed to engage the upper end guide surfaces 31 on the orienting body 21 while the flat face 61 along a major portion of the length of the guide arm is designed to contact the orienting surface 30 on the body 21. The upper end portion of the flat face 61 of the guide arm fits along the flat face 51 of the orienting head 23 when the guide arm is secured on the head. As shown in FIG. 7 the guide arm 24 is secured on the orienting head 23 by socket head screws or bolts 75 which engage the holes 73 in the arm 24 and the holes 55 in the head 23. Socket head screws 80 extend through the holes 74 in the arm 24 into the holes 60 of the head 23 to aid in holding the arm on the head.

Each of the seal and latch assemblies 25 included in the orienting head assembly 22 has a tubular landing nipple and seal mandrel 81 externally threaded along an upper end portion for connection into one of the bores 44 of the orienting head 23 and internally provided with an annular landing and locking recess profile 82 for releasably securing various well tools such as plugs in the bore of the nipple 81. An external annular seal assembly 83 is secured around each of the mandrels 81 for sealing around the mandrel with the surface defining the bores 32 of the orienting body 21. Tubular locking collets 84 having longitudinal circumferentially spaced collet fingers 85 provided with external locking bosses 90 are secured on the threaded lower end portions of the landing nipple and seal mandrels 81. The locking bosses 90 engage internal annular locking recesses along the orienting body bores 32 for releasably locking the orienting head assembly 23 with the orienting body 21. An internal latch sleeve 91 having circumferentially spaced locking collet fingers 92 with locking bosses 93 is positioned for longitudinal movement within each of the locking collets 84. The solid lower end portion of the locking collet 84 has longitudinally spaced internal annular locking recesses 94 and 95 which are sized to receive the locking collet bosses 93 on the latch sleeves 91. An internal annular operating shoulder 100 is provided within the solid upper end portion of each of the latch sleeves 91 for engaging the latch sleeves with a suitable operating tool to move the latch sleeves upwardly in the collets 84. A tubular end cap 96 threaded into the lower end of each collet 84 limits downward movement of the sleeves 91. The latch sleeves 91 are slidable between a lower release position, FIG. 3B, at which the locking bosses 93 on the collet fingers 92 engage the locking recess 95 of the collet 84 and an upper position at which the locking bosses 93 engage the locking recess 94 of the collet 84. When the latch sleeves 91 are at the lower position of FIG. 3B, the solid upper portion of the latch sleeves is below the collet fingers 85 so that the locking bosses 90 on the collet fingers 85 may be compressed inwardly for release of the seal and latch assemblies 25 from the bores of the orienting body 21. When the latch sleeves 91 are at the upper end position the solid upper end portions of the latch sleeves are disposed within the collet fingers 85 along the locking bosses 90 so that the collet fingers 85 cannot be compressed inwardly, and thus the latch and seal assemblies 25 are locked in the bores 32 of the orienting body 21.

The orienting body 21 is illustrated in detail in FIGS. 8A, 8B and 9–11. The orienting body is a tubular member provided with the longitudinal flat orienting side surface 30 which extends from the upper end of the body as shown in FIG. 8A to near the lower end of the body as illustrated in FIG. 8B. The upper end guide surfaces 31 on the body extend from the upper end of the flat side guide surface 30 merging together in a pointed edge 31*a* which extends substantially perpendicular to the longitudinal axis of the body as evident in FIG. 8A. The surface portions 31 are slightly concave surfaces which face outwardly along the end portion of the body terminating in the end edge 31*a* and are curved to conform with the configuration of the guide surface portions 33*b* of the orienting head 23 so that when the orienting head is coupled with the orienting body the upper end portion of the body fits within the guide surfaces of the head so that the end edge 31*a* of the body essentially engages the corner 33*d* along which the surface portions 33*b* merge on the head 23. The guide surfaces 31 on the upper end of the body 21 essentially revolve downwardly along the body so that the lower end tip of the guide arm will be directed to the guide surface 30 as the guide arm moves downwardly relative to the body during the coupling of the orienting head assembly with the orienting body. While the upper end portions of the guide surfaces 31 face outwardly to conform with the head guide surface portions 33*b* the lower end portions of the body guide surfaces 31 which merge into the flat guide surface 30 are revolved around to face inwardly toward the longitudinal axis of the orienting body. As evident in FIG. 9 the upper ends of the two longitudinal laterally spaced bores 32 open through the guide surfaces 31. Each of the bores 32 along the orienting body 21 includes an internal annular locking recess 32*a* for receiving the locking bosses 90 on the collet fingers 85 for each of the seal and latch assemblies 25 for releasably locking the orienting head assembly with the orienting body. The bore 32 have seal surfaces 32*b* above the locking recesses 32*a* along which the seal assemblies 83 seal with the bore wall when the head assembly is coupled with the body. The bores 32 also both include an internal annular no-go shoulder 32*c* which is designed to limit downward movement of certain other well tools which may be inserted into the orienting head such as pulling tools which form no part of the present invention. The no-go shoulder 32*c* in each of the bores 32 does not function during coupling of the orienting head with the orienting body. The limiting function in coupling the orienting head with the orienting body is the engagement of the end surfaces 31 and the end edge 31*a* on the body with the correspondingly shaped surfaces 33*b* and the corner edge 33*d* in the orienting head 23. In FIGS. 9 and 10 a cylindrical surface portion 31*b* is shown between the tip end 31*a* of the orienting body and the portions of the upper ends of the bores 32 which open through the upper end of the body. The surface portion 31*b* is formed as a manufacturing expedient by drilling into the upper end of the body preliminary to machining the guide surfaces and the bores 32 in the body. The cylindrical surface portion 31*b* is not a functional surface in the procedure of coupling the orienting head with the orienting body.

The lower end portions of the two bores 32 in the orienting body 21 are internally threaded at 32*d* as evident in FIG. 8B for the connection of the externally threaded upper end portion 110 of a mandrel in the packer 35. As shown in FIG. 3B there are two mandrels in the packer which thread into the lower end of the two bores 32 of the orienting body for connecting the orienting body on the upper end of the packer.

The first step in the installation of the well tubing coupling system of the invention is the setting of the packer 35 as illustrated in FIG. 1 within the well casing 34. The packer is connected with the upper ends of the tubing strings 40 and the orienting body 21 is connected on the upper end of the packer by means of the threaded upper end portions 110 of the mandrels in the two bores through the packer. The lower tubing strings 40, the packer 35, and the orienting body 21 on the upper end of the packer are lowered as a unit into the well bore and the packer is set at the desired depth in the casing 34 so that the lower tubing strings are suspended from the packer with the orienting body 21 supported on the top of the packer. Standard well completion procedures and tools are used for the installation of the packer.

After the packer 35 with the orienting body 21 and the lower tubing strings 40 are installed in a well, the orienting head assembly 22 is then made up on the lower ends of two upper tubing strings 41 and lowered into the well bore. During this step in the installation procedure the well is normally "killed" with drilling fluid for the purpose of keeping the well under control by means of the hydrostatic pressure of the drilling fluid which is applied to the formation pressure tending to displace production fluids up to the well bore. The orienting head 23 and the upper tubing strings 41 are lowered as a unit toward the orienting body 21 as represented schematically in FIG. 1. In FIG. 1 the orienting head and upper tubing strings are illustrated 180 degrees out of phase with the rotational position of the orienting body both because by so showing both the body and the head the operating parts of both the head and body are most visible and it is quite possible during this process that the body and head will be as much as 180 degrees out of phase with each other. As the orienting head assembly is lowered the lower end tip 71 of the guide arm 24 strikes either of the guide surfaces 31 or the upper end tip 31*a* on the orienting body 21. Exactly where the lower end tip of the guide arm engages the upper end of the orienting body will, of course, depend upon the extent to which the orienting head is misaligned from the orienting body. As the misalignment of the head from the body decreases the lower end tip of the guide arm will strike one of the guide surfaces lower down on the orienting body inasmuch as both of the surfaces 31 spiral down the body from the outside position at the tip 31*a* to an inner turned position where the guide surfaces 31 merge with the flat guide surface 30 along the side of the body 21. Irrespective of which of the guide surfaces 31 and how far down the guide surface the guide arm strikes the surface, the action force on the guide arm as the arm strikes the orienting body guide surface applies a rotating force to the guide arm which is transmitted to the orienting head and through the head to the supporting upper tubing strings 41. As the tubing strings and orienting head assembly continue to move downwardly the guide surfaces on the guide arm 24 follow the guide surfaces on the upper end of the orienting body until the guide arm is parallel with the guide surface 30 along the vertical side of the orienting body. The inside flat face 61 of the guide arm engages and moves along the guide surface 30 on the orienting body. The depth at which the packer 35 is normally set is sufficient that for the orienting head 22 to reach the orienting body 21 the upper tubing strings are of sufficient length that the tubing strings with the orienting head 22 may readily twist as much as 180 degrees without affecting the structural integrity of any of the system. After the guide arm 24 rotates the orienting head and upper tubing strings to properly align the orienting head assembly with the orienting body the lowering of the upper tubing strings and the orienting head assembly continues as the guide arm 24 slides along the orienting body guide surface 30 and the tubular seal and latch assemblies 25 enter the open upper ends of the bores 32 of the orienting body 21. During the installation of the orienting head assembly the latch sleeves 91 within the locking collets 84 are both at the lower end positions illustrated in FIG. 3B to permit the radial movement of the collet fingers 85 during the stabbing in of the seal and latch assemblies 25 into the orienting body bores 32. When the assemblies 25 have moved into the bores 32 to a depth at which the locking bosses 90 on the collet fingers 85 are aligned with the locking recesses 32*a* the collet fingers 85 expand outwardly moving the locking bosses 90 into the locking recesses 32*a* for releasably locking the seal and latch assemblies 25 in the bores of the orienting head 21. The seal assemblies 83 on the assemblies 25 engage the seal surface 32*b* along each of the bores 32. The downward movement of the orienting head assembly 23 is limited by the engagement of the upper guide surface portions 33*b* on the orienting head 23 with the guide surfaces 31 on the upper end of the orienting body. When the orienting head is lowered engaging the surfaces 33*b* with the orienting body surfaces 31 the locking bosses 90 on the collets 84 of the seal and latch assemblies 24 are properly aligned with the locking recesses 32*a* within the bores of the orienting body for releasably locking the orienting head assembly with the orienting body. After the orienting head assembly is coupled with the orienting body and the collet finger locking bosses 90 engaged in the orienting body bore recesses 32*a* a suitable operating tool is run from the surface through both the upper tubing strings into the bores of the seal and latch assemblies 25 engaging the operating shoulder 100 within the latch sleeves 91 to pull the latch sleeves from the lower end position shown in FIG. 3B to an upper end position at which the latch sleeve locking bosses 93 engage the locking recesses 94 in the collet member 85. At the upper positions of the latch sleeves the solid upper end portion of the latch sleeves is disposed within the collet fingers 85 preventing inward movement of the collet fingers so that the locking bosses 90 on the collet fingers 85 remain in expanded locking positions. The upper tubing strings and orienting head assembly 23 cannot be uncoupled from the orienting body 21 so long as the latch sleeves 91 are at such an upper end position.

When removal of the upper tubing strings is desired the strings may be pulled and rerun independently of the packer 35 in the lower tubing strings because of the particular features of the invention permitting the coupling and uncoupling of the orienting head assembly 23 and the orienting body 21. It is preferred that when removing the upper tubing strings and orienting head assembly the procedure not be performed under operating well pressure. One method of shutting in a well bore to avoid pulling the upper tubing strings under pressure includes setting suitable bridge plugs in the packer 35 or the lower tubing strings 40 below the packer to isolate the producing formation pressures in the lower tubing strings during the removal of the upper tubing strings and orienting head assembly. It is possible to use a dual snubbing unit for removal of the upper tubing strings under pressure though such technique is not preferred.

After suitably isolating or shutting in the well bore at or below the packer 35 a suitable operating tool is run through both of the upper tubing strings 40 to grasp the latch sleeve 91 in each of the seal and latch assemblies 25 of the orienting head assembly moving the latch sleeve downwardly to the lower end release position of FIG. 3B. This frees the collet fingers 85 to compress inwardly for disengagement of the collet finger locking bosses 90 from the locking recesses 32*a* in the bores 32 of the orienting body 21. The upper tubing strings 41 and the orienting head assembly 23 are then pulled upwardly as a unit. The collet finger locking bosses 90 are cammed inwardly at the upper end of the locking recesses 32*a* releasing the orienting head assembly from the orienting body permitting retrieval of the upper tubing strings and the orienting head assembly.

The upper tubing strings 41 and orienting head assembly 23 may be reinstalled as a unit following the procedural steps outlined for the original installation of the tubing coupling system.

It will now be seen that a new improved system for releasably coupling upper tubing strings with lower tubing strings at a packer has been described and illustrated. The system permits the removal of the upper tubing strings without disturbing the packer and the lower tubing strings. The upper tubing strings are removed and reinstalled as a unit. The orienting head assembly is lockable into both of the bores of the orienting body. The manipulation of the upper tubing strings including running and removal of the strings is accomplished without disturbing the packer and lower tubing strings. The arrangement of guide surfaces and the guide arm employed permit the use of larger tubing strings than currently available tubing coupling systems provide.

It will be recognized that while the tubing coupling system of the invention has been described and illustrated in terms of two tubing strings, it is to be understood that the system may include structure for coupling more than two tubing strings.

What is claimed is:

1. A round tubular well flow conductor coupling system comprising: first fluid coupling means having longitudinal flow passages; second fluid coupling means adapted to be releasably coupled with said first fluid coupling means having longitudinal fluid flow passages sized and positioned to communicate with said flow passage means in said first coupling means and being connectible with a flow conductor; a longitudinally extending guide arm having an inside longitudinal guide surface secured on and extending longitudinally beyond the free end of one of said fluid coupling means; and a longitudinally extending outside guide surface shaped to mate with said guide arm guide surface defined along the other of said fluid coupling means aligned parallel with and laterally spaced from said longitudinal flow passages means in said fluid coupling means.

2. A well flow conductor coupling system in accordance with claim 1 wherein one of said fluid coupling means is provided with a free end edge defining a concave female surface extending peripherally around said fluid coupling means between opposite side edges of the longitudinal guide surface connected on said fluid coupling means and a free end edge on the other of said fluid coupling means defining a convex guide surface extending peripherally around said other of said fluid coupling means around a substantial portion of said coupling means along the opposite side of said coupling means from the longitudinal guide surface on said coupling means.

3. A well flow conductor coupling system in accordance with claim 2 wherein said guide arm is on said fluid coupling means having said concave female end surface and is of sufficient length to engage said other coupling means prior to engagement of said female and male end mating surfaces on said first and second coupling means.

4. A well flow conductor coupling system in accordance with claim 3 wherein said guide arm is positioned to engage said male end surface on the other of said coupling means prior to engagement of said guide arm with said longitudinal guide surface on said other of said coupling means.

5. A well flow conductor coupling system in accordance with claim 3 wherein said guide arm has a longitudinal flat inside orientation surface and said longitudinal orientation surface along said other coupling means is a flat surface.

6. A well flow conductor coupling system in accordance with claim 4 wherein said guide arm has a flat longitudinal inside orientation surface and said orientation surface on said other coupling means is a flat surface.

7. A cylindrical well tubing coupling system for removably connecting the lower end of an upper tubing string system with the upper end of a lower tubing string system comprising: an orienting body adapted to be secured on the upper end of a well packer supporting said lower tubing string system, said orienting body having longitudinal flow passages therethrough positioned to communicate with flow passages through said packer leading to said lower tubing string system when said orienting body is secured on said packer, means on said orienting body defining a longitudinal flat orienting surface along an outer side of said orienting body extending along said body from the upper end thereof, and means on the upper end of said orienting body defining a male orienting and guide surface; and an orienting head assembly adapted to be connected at an upper end with the lower end of said upper tubing system, said orienting head assembly comprising an orienting head having means on a lower end edge defining a female orienting and guide surface adapted to mate with said male orienting and guide surface on said orienting body, said orienting head having longitudinal flow passages corresponding with said flow passages in said orienting body and adapted to communicate with said upper tubing string system, a longitudinally extending guide arm secured along an upper end along one side of said orienting head and extending from said orienting head beyond said female surface to engage said male orienting and guide surface on the upper end of said orienting body and said orienting surface along the side of said orienting body, and a seal and latch assembly secured in each of said flow passages of said orienting head and extending from said head along said guide arm for telescopic engagement in said flow passages of said orienting body when said orienting head assembly is coupled with said orienting body.

8. A well tubing coupling system in accordance with claim 7 wherein each of said male and female guide and orienting surfaces on said orienting body and orienting head comprises two helicoid surfaces generated about the longitudinal axis of said head and said body extending from the free end of said head and said body longitudinally along and around said head and said body substantially 180 degrees.

9. A well tubing coupling system in accordance with claim 8 wherein said guide arm has a tapered lower end portion defined by side edge surfaces converging toward the free end of said arm for engagement with said male guide surfaces on said orienting body to rotate said guide arm into alignment with said flat guide surface along the side of said guide body.

10. A well tubing coupling system in accordance with claim 9 wherein each of said seal and latch assemblies of said orienting head assembly includes a tubular locking collet, a longitudinal removable latch sleeve within said collet for locking said collet, external annular seal means for sealing around said seal and latch assembly in a bore of said orienting body, and said orienting body has longitudinally spaced seal surfaces for said seal means on said seal and latch assembly and annular locking recess means for said locking collet on said seal and latch assembly.

11. A well tubing coupling system in accordance with claim 10 wherein said guide arm has a arcuate external surface portion and a flat internal guide surface portion.

12. A well tubing coupling system in accordance with claim 11 wherein said orienting body has two of said longitudinal flow passages and said orienting head assembly has two of said longitudinal flow passages and one of said seal and latch assemblies connected in each of said two flow passages for forming sealing engagement with said flow passages in said orienting body.

* * * * *